US008011869B2

(12) United States Patent
Trovinger et al.

(10) Patent No.: US 8,011,869 B2
(45) Date of Patent: Sep. 6, 2011

(54) METHOD AND ASSEMBLY FOR BINDING A BOOK WITH ADHESIVE

(75) Inventors: Steven W. Trovinger, Los Altos, CA (US); Ross R. Allen, St. Helena, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 211 days.

(21) Appl. No.: 12/206,459

(22) Filed: Sep. 8, 2008

(65) Prior Publication Data

US 2009/0003971 A1 Jan. 1, 2009

Related U.S. Application Data

(62) Division of application No. 11/286,574, filed on Nov. 23, 2005, now abandoned.

(51) Int. Cl.

| | |
|---|---|
| ***B42C 9/00*** | (2006.01) |
| ***B42C 11/00*** | (2006.01) |
| ***B42C 11/02*** | (2006.01) |
| ***B42C 5/00*** | (2006.01) |
| ***B42B 5/00*** | (2006.01) |

(52) U.S. Cl. ..... 412/8; 412/4; 412/19; 412/25; 412/33; 412/37

(58) Field of Classification Search ..... 118/238; 227/14, 99; 270/52.18; 412/25, 33, 4, 8, 412/19, 32, 37; *B42B 4/00; B42C 11/00, B42C 11/02; B65H 31/30, 39/10*

See application file for complete search history.

(56) References Cited

U.S. PATENT DOCUMENTS

| | | | | |
|---|---|---|---|---|
| 2,119,511 | A | 6/1938 | Perkins | |
| 3,634,995 | A | 1/1972 | Curtis | |
| 4,715,758 | A | 12/1987 | Stobb | |
| 4,915,415 | A | 4/1990 | Sendor et al. | |
| 5,028,193 | A | 7/1991 | Misicka | |
| 5,429,682 | A | 7/1995 | Harlow et al. | |
| 5,716,182 | A * | 2/1998 | Leu | 412/8 |
| 6,099,225 | A | 8/2000 | Allen et al. | |
| 6,328,519 | B1 | 12/2001 | Nagai | |
| 6,550,756 | B2 | 4/2003 | Trovinger | |
| 6,554,267 | B2 | 4/2003 | Trovinger | |
| 6,578,838 | B2 | 6/2003 | Trovinger et al. | |
| 6,619,900 | B2 | 9/2003 | Cobene, II et al. | |
| 6,641,345 | B2 | 11/2003 | Cobene, II et al. | |
| 6,708,967 | B1 | 3/2004 | Trovinger et al. | |
| 6,715,749 | B2 | 4/2004 | Trovinger | |
| 6,722,645 | B2 | 4/2004 | Lorenzi | |
| 6,732,777 | B2 | 5/2004 | Ertel et al. | |
| 6,739,816 | B1 | 5/2004 | Schuder et al. | |

(Continued)

FOREIGN PATENT DOCUMENTS

EP 0992 365 A1 4/2000

(Continued)

*Primary Examiner* — Shelley Self
*Assistant Examiner* — Justin Lewis

(57) ABSTRACT

An adhesive application assembly is configured for use in a book binding station that includes a saddle for supporting a plurality of sheets. The adhesive application assembly includes an adhesive applicator, a movable support arm supporting the adhesive applicator, and a drive mechanism. The drive mechanism is coupled with the support arm and is configured to move the support arm and the adhesive applicator toward the saddle to apply adhesive to an outermost sheet on the saddle.

11 Claims, 8 Drawing Sheets

U.S. PATENT DOCUMENTS

| | | | | |
|---|---|---|---|---|
| 6,796,554 | B2 | 9/2004 | Trovinger | |
| 6,834,853 | B2 | 12/2004 | Trovinger et al. | |
| 2001/0048862 | A1 * | 12/2001 | Baumann et al. | 412/4 |
| 2002/0067977 | A1 | 6/2002 | Cobene, II et al. | |
| 2002/0106264 | A1 | 8/2002 | Cobene, II et al. | |
| 2002/0119029 | A1 | 8/2002 | Cobene et al. | |
| 2002/0168247 | A1 | 11/2002 | Trovinger et al. | |
| 2002/0168248 | A1 | 11/2002 | Ertel et al. | |
| 2003/0161704 | A1 | 8/2003 | Trovinger | |
| 2003/0161705 | A1 | 8/2003 | Trovinger | |
| 2003/0162644 | A1 | 8/2003 | Trovinger | |
| 2004/0009054 | A1 | 1/2004 | Cobene, II et al. | |
| 2004/0038794 | A1 | 2/2004 | Hoarau | |
| 2004/0052613 | A1 | 3/2004 | Trovinger | |
| 2004/0086359 | A1 | 5/2004 | Ertel et al. | |
| 2004/0089999 | A1 | 5/2004 | Trovinger et al. | |
| 2004/0091336 | A1 | 5/2004 | Trovinger | |
| 2004/0094884 | A1 | 5/2004 | Trovinger et al. | |
| 2004/0094891 | A1 | 5/2004 | Trovinger et al. | |
| 2004/0175255 | A1 | 9/2004 | Trovinger et al. | |
| 2004/0188910 | A1 | 9/2004 | Trovinger et al. | |
| 2004/0239027 | A1 | 12/2004 | Trovinger et al. | |
| 2004/0240965 | A1 | 12/2004 | Schuder et al. | |
| 2004/0240966 | A1 | 12/2004 | Cobene, II | |
| 2005/0011610 | A1 | 1/2005 | Cobene, II | |
| 2005/0056986 | A9 | 3/2005 | Trovinger et al. | |
| 2005/0095086 | A1 | 5/2005 | Cobene et al. | |

FOREIGN PATENT DOCUMENTS

| | | |
|---|---|---|
| WO | WO 00/18583 | 4/2000 |

* cited by examiner

METHOD AND ASSEMBLY FOR BINDING A BOOK WITH ADHESIVE

CROSS-REFERENCE TO RELATED APPLICATIONS

This application is a divisional application of U.S. patent application Ser. No. 11/286,574 entitled "METHOD AND ASSEMBLY FOR BINDING A BOOK WITH ADHESIVE," filed Nov. 23, 2005 now abandoned, which is incorporated herein by reference.

BACKGROUND

Electronic document publishing often demands more than a stack of paper in an output tray of an office printer. Typically, a plurality of duplex printed sheets are bound into finished documents by a publishing system that prints and finishes books. Publishing systems perform operations such as collating, binding, folding, trimming, stapling, etc. These finishing operations are typically performed on all of the sheets in a book at one time, which generally requires the use of high forces and powerful motors. Consequently, the systems adapted to perform these functions are relatively expensive and often exceed the cost of other desktop or office printers. As such, known publishing systems are not generally well suited for use in low-cost desktop bookmaking.

In particular, publishing systems typically require high forces to bind a document. Conventional desktop or office publishing systems form saddle-bound documents with staples that are pushed through the stack of papers and deformed to bind the stack of papers together. In order to staple stacks of paper, relatively high forces are utilized, which requires more powerful motors to be incorporated into the publishing system, therefore, increasing costs associated with the publishing systems. Therefore, a need exists for a publishing system that decreases forces and motor power used within the publishing system to form a saddle-bound document and that is suitable for use with office printers and for methods associated therewith.

SUMMARY

One aspect of the present invention relates to an adhesive application assembly configured for use in a book binding station that includes a saddle for supporting a plurality of sheets. The adhesive application assembly includes an adhesive applicator, a movable support arm supporting the adhesive applicator, and a drive mechanism. The drive mechanism is coupled with the support arm and is configured to move the support arm and the adhesive applicator toward the saddle to apply adhesive to an outermost sheet on the saddle.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "down," "over," "above," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following Detailed Description, therefore, is not to be taken in a limiting sense, and the scope of the present invention is defined by the appended claims.

Figure 1:
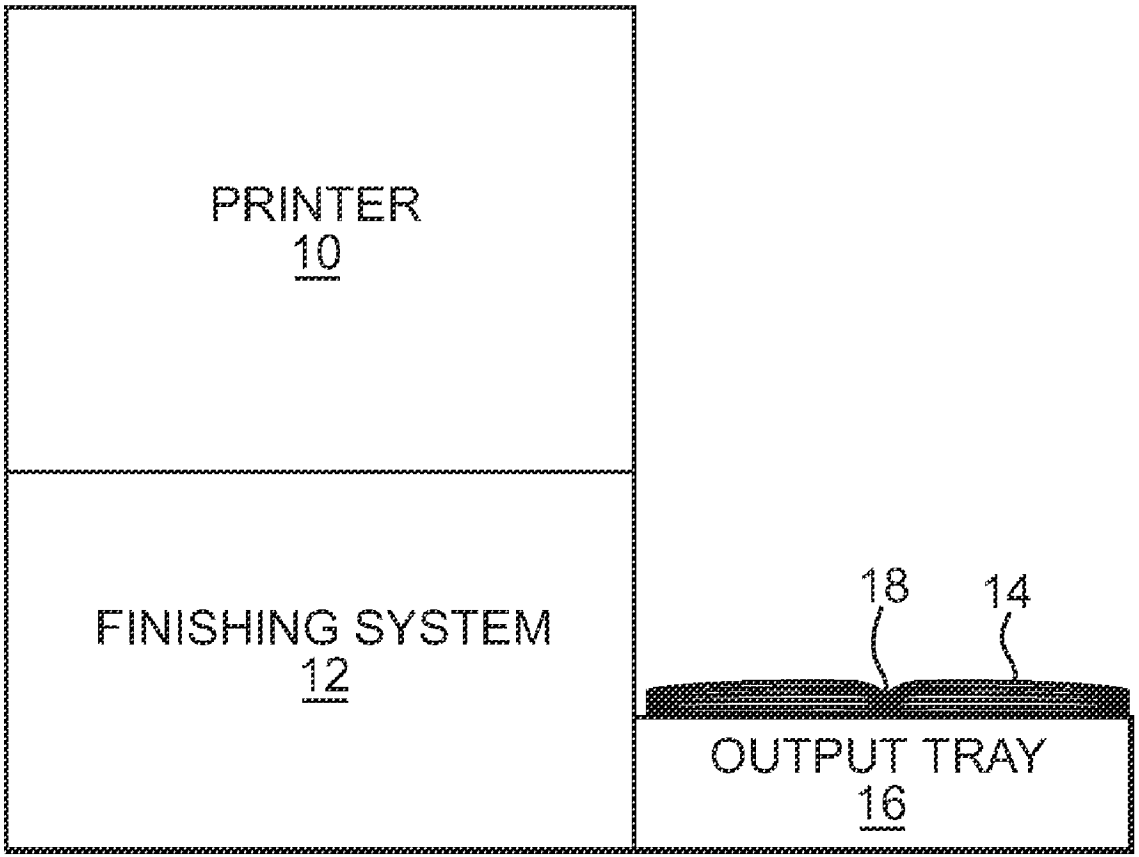
FIG. 1 is block diagram illustrating one embodiment of a printer and a finishing system suitable for use in forming bound documents.

FIG. 1 is a block diagram illustrating one embodiment of a printer 10 and a finishing system 12 suitable for use in forming saddle-bound documents or other booklets as part of a low-cost system configured to produce finished documents in the electronic publishing environment. In one embodiment, printer 10 prints a plurality of sheets which are fed to finishing system 12 for folding, collating, binding, and performing other finishing operations, if any. In one embodiment, finishing system 12 forms bound document 14 as a saddle-bound document. Finishing system 12 outputs bound document 14 to an output tray 16 where bound document 14 is accessible by a user. Bound document 14 may be output from finishing system 12 in either an open or a closed configuration.

In one embodiment, finishing system 12 is configured to produce a document 14 bound along a spine 18 with diminished forces as compared to conventional finishing systems. For example, finishing system 12 is configured to bind documents 14 with adhesive, which typically utilizes diminished forces as compared to stapling or other binding mechanisms. Accordingly, lower force motors can be used within finishing system 12, thereby, decreasing the overall costs associated with obtaining and servicing the finishing system 12.

Figure 2:
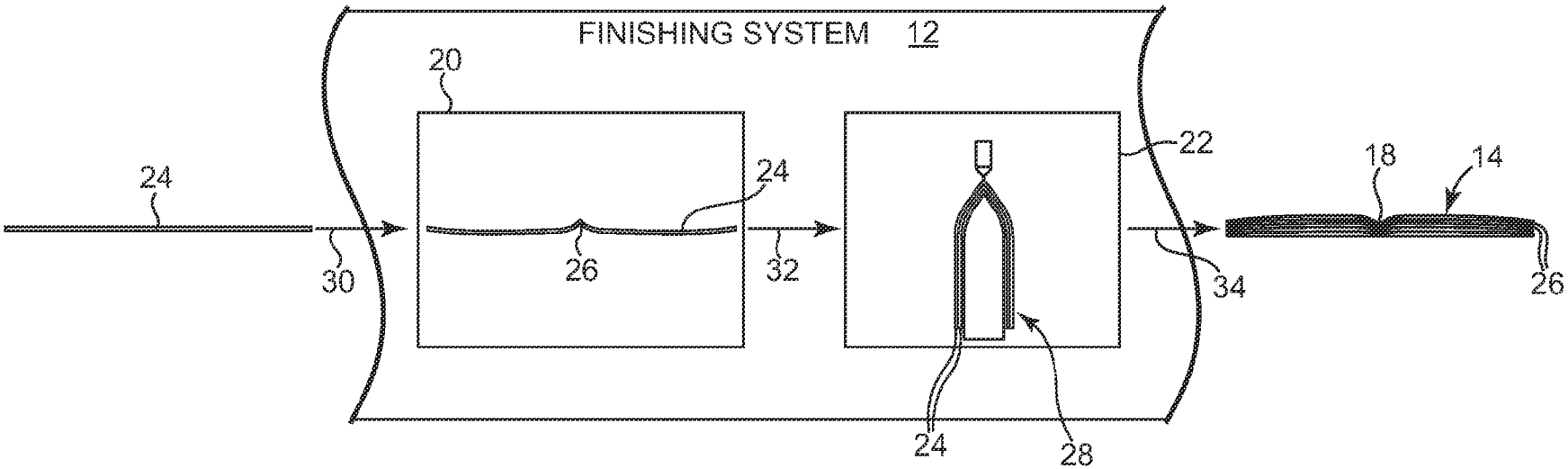
FIG. 2 is a schematic illustration of one embodiment of a sheet path through a finishing system of FIG. 1.

FIG. 2 is a schematic illustration of one embodiment of a sheet path through at least a portion of finishing system 12. In one embodiment, finishing system 12 includes a plurality of finishing stations, including, for example, a folding station 20 and a binding station 22. Folding station 20 is configured to fold one or more sheets 24 at a time to define a fold line 26 in each sheet 24. In one embodiment, binding station 22 is configured to accumulate sheets 24 into a sheet stack 28 and to adhere each sheet to at least one adjacent sheet 24 in sheet stack 28 to define spine 18. Once sheets 24 are adhered to one another in sheet stack 28, sheet stack 28 is output from binding station 22 as bound document 14 to another finishing station, such as a trimming station, or to output tray 16 (illustrated in FIG. 1).

In one embodiment, sheets 24 move along a sheet path collectively illustrated by arrows 30, 32, and 34. Arrow 30 generally illustrates movement of sheet 24 from printer 10 or another finishing station to fold station 22. Arrow 32 generally illustrates movement of sheet 24 from fold station 22 to binding station 24, and arrow 34 generally illustrates movement of sheet stack 28 to another finishing station or output tray 16 as bound document 14. As illustrated, in one embodiment, each sheet 24 transitions through finishing system 12 generally moving in a direction substantially perpendicular to the orientation of the respective fold line 26 formed in each sheet 24.

Figure 3:
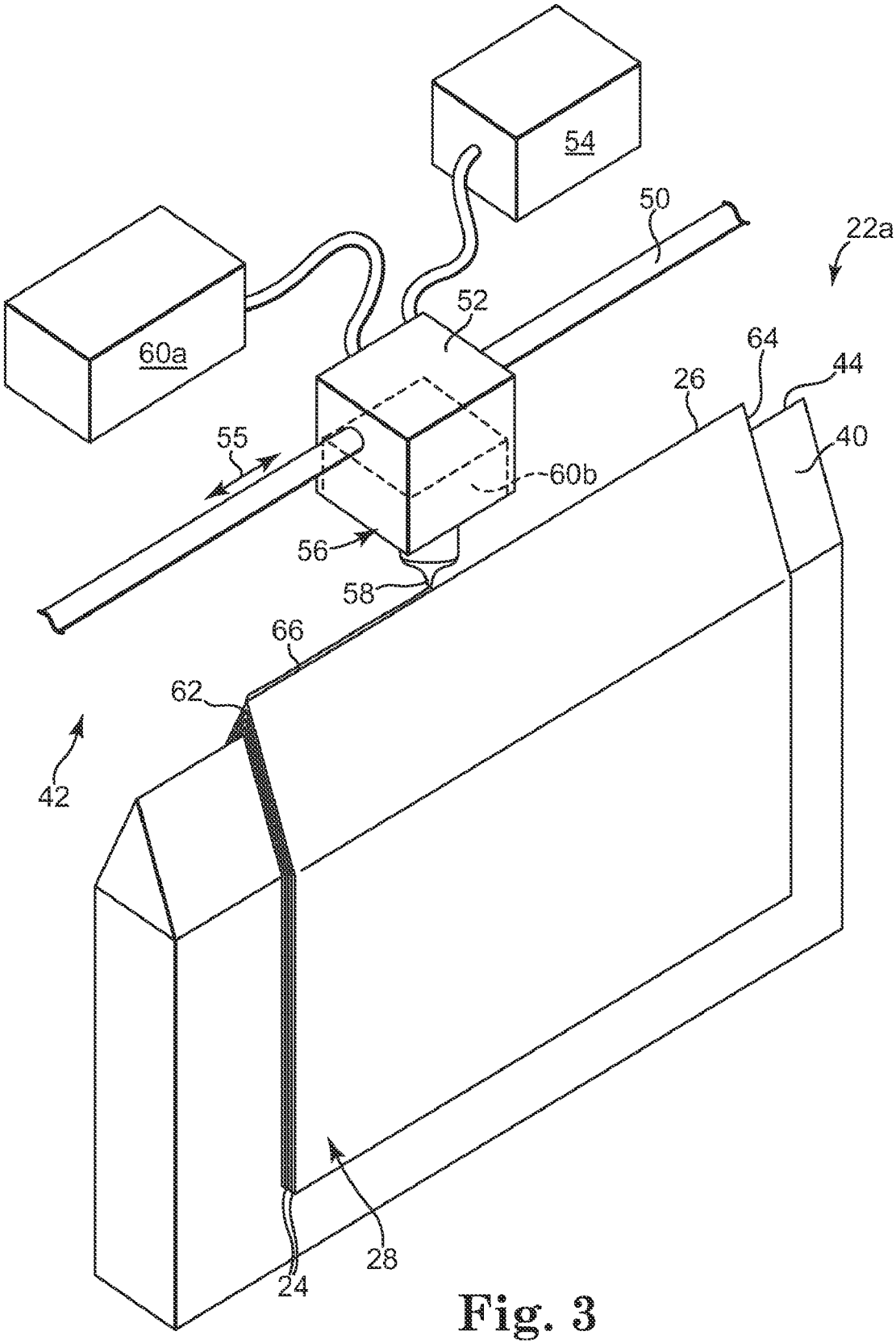
FIG. 3 is a perspective illustration of one embodiment of a binding station included in the finishing system of FIG. 2.

FIG. 3 illustrates one embodiment of a binding station 22*a* configured for inclusion within finishing system 12. Binding station 22*a* includes a saddle 40 and an adhesive application assembly 42. Saddle 40 is any suitable device configured to support a sheet stack 28 received from previous finishing stations, such as folding station 20. In one embodiment, saddle 40 is configured to receive individual, folded sheets 24 from folding station 20 and to accumulate sheets 24 into sheet stack 28. In one embodiment, saddle 40 is any sheet support, such as, for example, a substantially rectangular support having a pointed edge 44, for receiving each sheet 24. In one embodiment, saddle 40 is substantially stationary. In one embodiment, one sheet 24 is received on saddle 40 at a time in an at least partially open position such that fold line 26 of each sheet 24 is aligned with and placed over pointed edge 44 and is aligned with and positioned over fold lines 26 of any other sheets 24 previously accumulated on sheet stack 28.

Adhesive application assembly 42 is an assembly configured to selectively apply adhesive along fold line 26 of an outermost sheet 24 supported by saddle 40. In one embodiment adhesive application assembly 42 includes a support rod 50, an adhesive delivery carriage 52, and a drive mechanism 54. Support rod 50 is spaced from and extends substantially parallel to and over pointed edge 44 of saddle 40. In one embodiment, support rod 50 is secured to a frame or other support mechanism within finishing system 12. Carriage 52 is movably coupled to support rod 50 and is configured to translate back and forth along support rod 50 as generally indicated by arrow 55. Drive mechanism 54 is coupled with carriage 52 and is any suitable mechanism configured to drive movement of carriage 52 along support rod 50 as generally indicated by arrow 55.

In one embodiment, carriage 52 includes an adhesive applicator 56 configured to deliver, eject, or otherwise dispense adhesive along fold line 26 of sheet 24. In one embodiment, adhesive applicator 56 includes one or more nozzles 58. Each nozzle 58 is positioned over and spaced from pointed edge 44 of saddle 40 and, therefore, fold line 26 of any sheets 24 on saddle 40. In one embodiment, adhesive applicator 56 is in communication with at least one adhesive reservoir, such as a reservoir 60*a* and/or a reservoir 60*b*, containing liquid adhesive. In one embodiment, reservoir 60*a* is positioned external to carriage 52 and is coupled to carriage 52. In one embodiment, reservoir 60*b* is included on or within carriage 52. Each reservoir 60*a* and 60*b* is configured to be refilled with liquid adhesive as needed and/or to be replaced with a new reservoir 60*a* or 60*b* upon consumption of the liquid adhesive stored therein.

The adhesive stored in reservoir 60*a* or 60*b* is any suitable adhesive having sufficient strength to permanently or semi-permanently bond sheets 24 in sheet stack 28 together to form bound document 14. In one embodiment, liquid adhesive stored in reservoir 60*a* or 60*b* has a viscosity sufficiently low enough to allow the adhesive to be ejected onto sheets 24 via nozzle 58, but sufficiently high enough to avoid or decrease unintended migration of the liquid adhesive once it is applied to sheet 24. For example, in one embodiment, liquid adhesive is sufficiently viscous to avoid migration over edges 62 and/or 64 that could prevent full opening of bound document 14. In one embodiment, the adhesive is a hot melt adhesive, a cold glue, a water based adhesive, a moisture-carrying adhesive, a non-moisture-carrying adhesive, or any other suitable adhesive.

In one embodiment, during use, carriage 52 translates along support rod 50 moving nozzle 58 over fold line 26 between a first edge 62 of sheet 24 and an opposite, second edge 64 of sheet 24. Accordingly, a continuous line of adhesive, which is generally indicated at 66, is formed on fold line 26. The thickness of line of adhesive 66 is exaggerated for clarity in the illustration of FIG. 3. In other embodiments, line of adhesive 66 may start at a position on fold line 26 spaced from first edge 62 and/or stop at a position on fold line 26 spaced from second edge 64. In another embodiment, nozzle 58 is configured to intermittently eject adhesive as carriage 52 translates over saddle 40. In this embodiment, line of adhesive 66 is not continuous, but rather is divided into a plurality of lengths of adhesive (not illustrated) spaced along fold line 26. In one embodiment, the amount of adhesive to be applied to fold line 26 is determined based upon the properties of the adhesive and/or sheets 24 to provide a desired bond strength between adjacent sheets 24 in sheet stack 28.

Once line of adhesive 66 is in place, the adhesive remains tacky until the next sheet 24 is added to sheet stack 28. In particular, a partially open, second sheet 24 is positioned over saddle 40 such that fold line 26 of new sheet 24 contacts line of adhesive 66 to adhere first sheet 24 with second sheet 24. In one embodiment, pressure is applied on second sheet 24 to further encourage adhesion to the adjacent first sheet 24. The process of applying a line of adhesive 66 and adding another sheet 24 is repeated until all sheets 24 for bound document 14 have been added to sheet stack 28. In this manner, sheet stack 28 is formed as bound document 14 and is output from saddle 40 to another finishing station or output tray 16 (illustrated in FIG. 1). In one embodiment, additional binding means such as staples, etc. are utilized in addition to the adhesive 66.

Figure 4A:
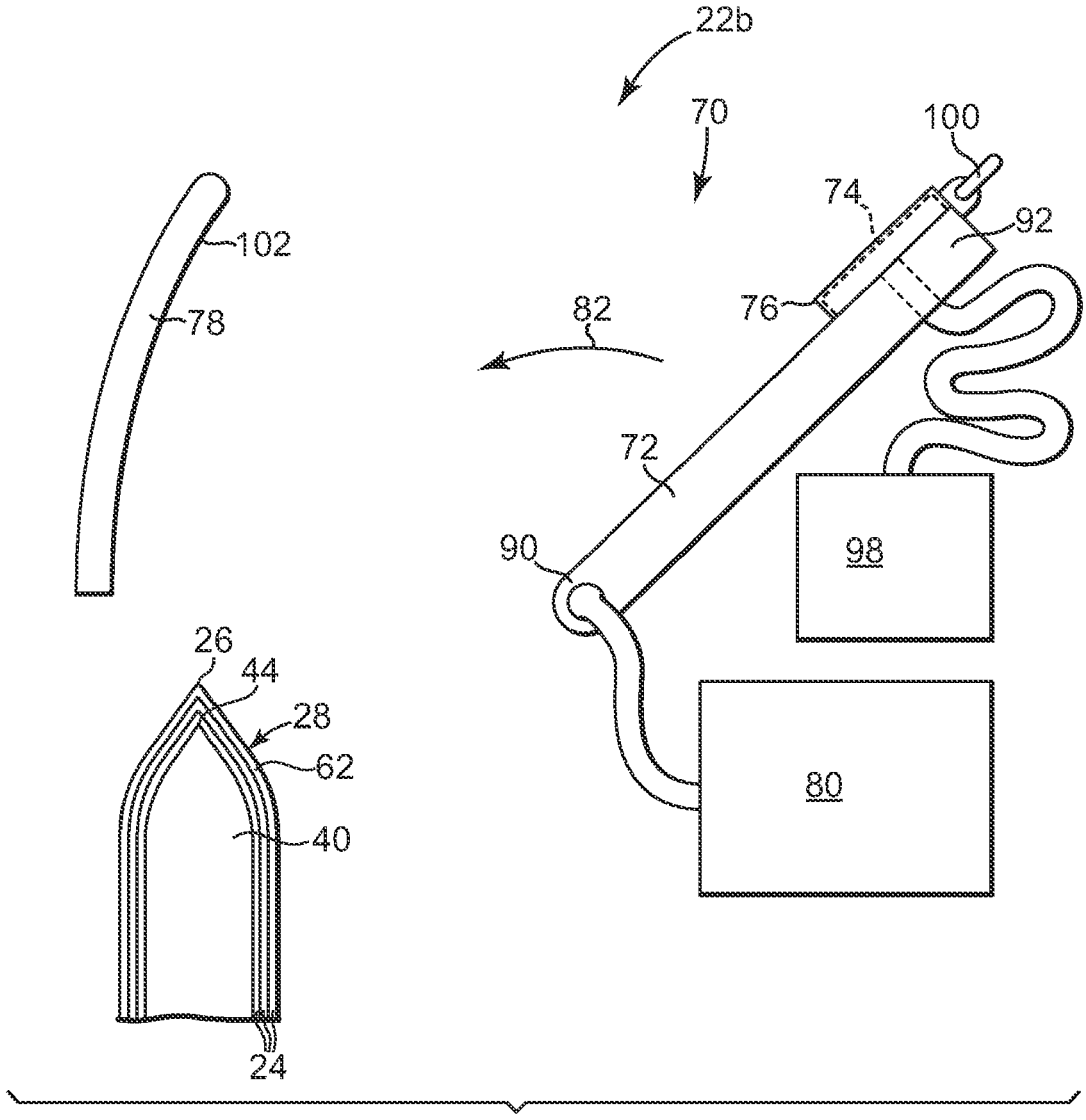
FIG. 4A is a side illustration of one embodiment of a binding station, which is included in the finishing system of FIG. 2, in a first position.
Figure 4B:
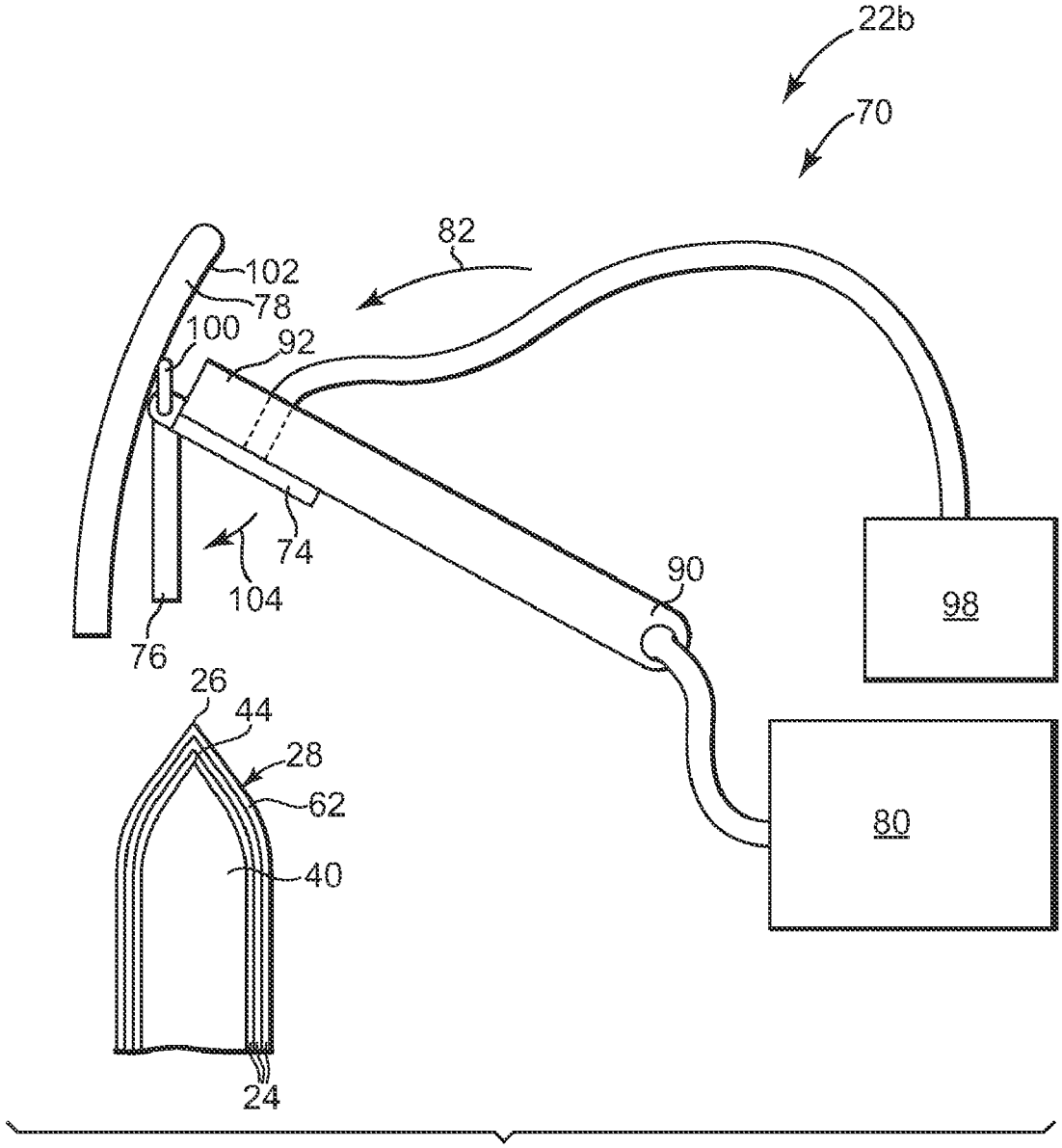
FIG. 4B is a side illustration of the binding station of FIG. 4A in a second position.
Figure 4C:
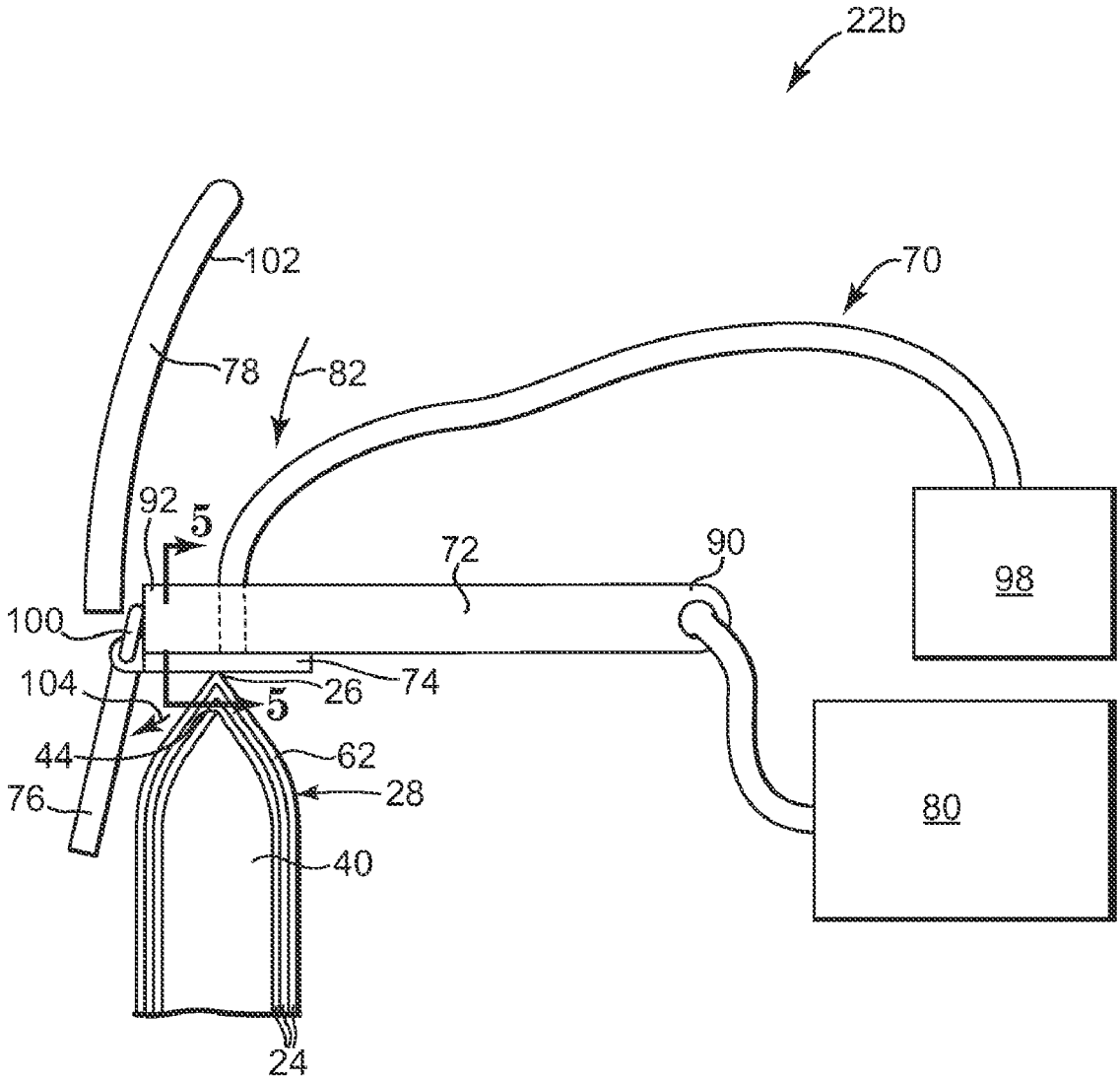
FIG. 4C is a side illustration of the binding station of FIG. 4A in a third position.

FIGS. 4A-4C illustrate another embodiment of a binding system 22*b* configured for inclusion within finishing system 12. Binding system 22*b* includes saddle 40 and an adhesive application assembly 70. Adhesive application assembly 70 is positioned substantially above saddle 40 and is configured to selectively apply adhesive to sheets 24 positioned on saddle 40. In one embodiment, adhesive application assembly 70 includes movable support arm 72, an adhesive applicator 74, a cap 76, a cam activation member 78, and a drive mechanism 80. Movable support arm 72 is movably coupled with a frame or other supporting structure (not illustrated) within binding station 22*b*. Adhesive applicator 74 is secured to support arm 72, and cap 76 is configured to selectively cover adhesive applicator 74.

Drive mechanism 80 is configured to move support arm 72 and, therefore, adhesive applicator 74 toward saddle 40 as generally indicated by arrow 82. In particular, drive mechanism 80 drives support arm 72 movement between a neutral position (illustrated in FIG. 4A) and an application position (illustrated in FIG. 4C). Although a curvilinear movement path is illustrated for support arm 72, in other embodiments, the movement path of support arm 72 may be linear. In one embodiment illustrated in FIGS. 4B and 4C and more fully described below, as support arm 72 is moved toward saddle 40, cap 76 interacts with cam activation member 78 to move cap 76 away from adhesive applicator 74. After cap 76 is removed, support arm 72 continues to move toward saddle 40 until adhesive applicator 74 contacts saddle 40 and/or any outermost sheet 24 supported by saddle 40 to apply adhesive along fold line 26 of any such sheet 24.

In one embodiment, support arm 72 is an elongated member formed of any suitable, generally rigid material, such as metal or plastic. Support arm 72 defines a first end 90 and a second end 92 opposite first end 90. First end 90 is movably coupled, or more particularly, in one embodiment, rotatably coupled, to the frame or support structure within binding station 22*b*. In one embodiment, support arm 72 is biased to the neutral position illustrated in FIG. 4A with a spring or any other suitable device or assembly. In one embodiment, support arm 72 extends substantially perpendicular to the longitudinal extension of pointed edge 44 of saddle 40.

Adhesive applicator 74 is mounted near second end 92 of support arm 72. Adhesive applicator 74 is any suitable applicator configured to apply adhesive to sheets 24 on saddle 40. In one embodiment, adhesive applicator 74 is an adhesive pad 74. In one embodiment, adhesive pad 74 is a solid adhesive or is a pad formed of other material configured to selectively retain a non-solid adhesive. In such an embodiment, adhesive pad 74 may be formed as a consumable product that is replaceable with another adhesive pad 74 when substantially all the adhesive of adhesive pad 74 is consumed.

Figure 5A:
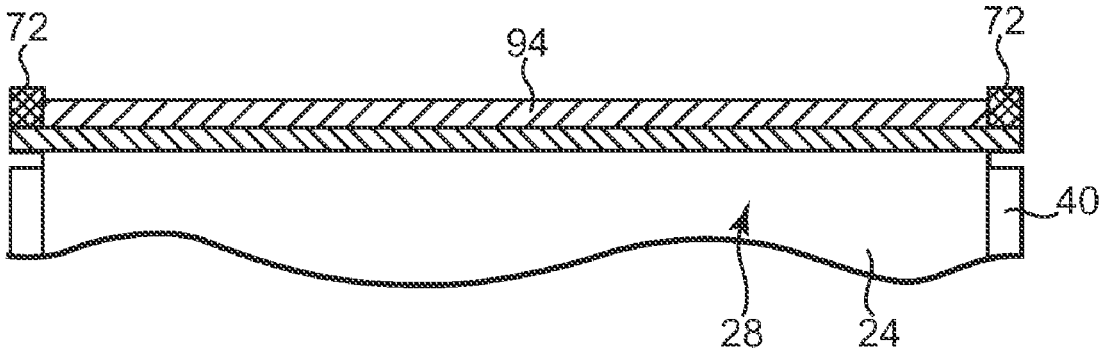
FIG. 5A is a cross-sectional illustration of one embodiment of the binding station of FIG. 4C taken along the line 5-5.
Figure 5B:
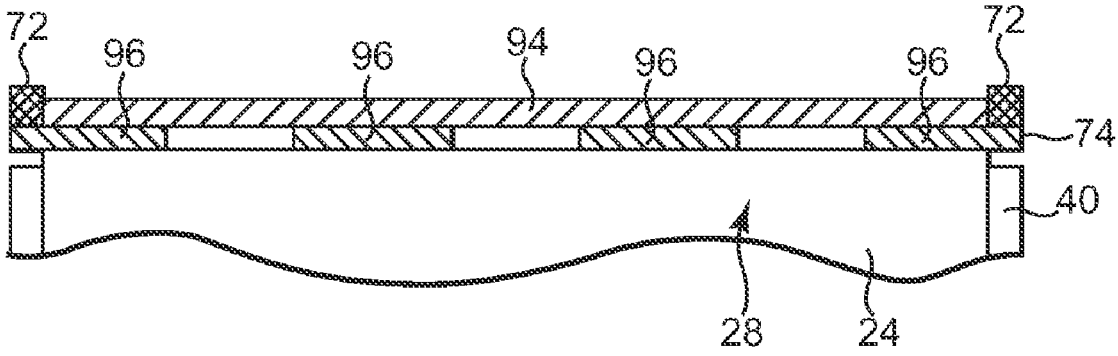
FIG. 5B is a cross-sectional illustration of another embodiment of the binding station of FIG. 4C taken along the line 5-5.

In one embodiment, as illustrated with reference to FIGS. 4C and 5A, a secondary support member 94 extends between and with a substantially perpendicular orientation with respect to two substantially identical support arms 72 to provide further support to adhesive pad 74. In one embodiment, adhesive pad 74 linearly extends across a substantial entirety of a length of fold line 26 in sheet 24 maintained by saddle 40. Accordingly, adhesive pad 74 is configured to apply adhesive (similar to line of adhesive 66 illustrated in FIG. 3) substantially continuously along a length of fold line 26. In another embodiment, as illustrated with reference to FIG. 5B in view of FIG. 4C, adhesive pad 74 is one of a plurality of adhesive pads 96 linearly aligned and spaced from one another. In one embodiment, each adhesive pad 96 is supported by secondary support member 94. Each of the plurality of adhesive pads 96 is configured to contact fold line 26 while adhesive application assembly 70 is in the application position illustrate in FIG. 4C. Accordingly, in this embodiment, adhesive is not applied continuously, but rather is divided into a plurality of lengths of adhesive (not illustrated) spaced along fold line 26. In one embodiment, the amount of adhesive to be applied to fold line 26 is determined based on adhesive properties and/or sheet properties to provide a desired bond strength between adjacent sheets 24 in sheet stack 28.

Once again referring to FIG. 4A, in one embodiment, adhesive pad 74 is coupled with an adhesive reservoir 98 storing liquid adhesive and being coupled with adhesive pad 74. As such, a sufficient amount of liquid adhesive is continuously or periodically transferred from reservoir 98 to adhesive pad 74 for application to sheets 24, as will be further described below. In one embodiment, adhesive reservoir 98 is configured to be refilled or replaced when substantially all of the liquid adhesive originally in adhesive reservoir 98 has been consumed. In other embodiments, no adhesive reservoir 98 is included in adhesive application assembly 70.

The adhesive stored in adhesive pad 74 and/or adhesive reservoir 98 is any suitable adhesive having sufficient strength to permanently or semi-permanently bond sheets 24 in sheet stack 28 together to form bound document 14. In one embodiment, in which a liquid adhesive is stored in adhesive pad 74 and/or adhesive reservoir 98, the viscosity of the adhesive is sufficiently low to be transferred from adhesive pad 74 to sheets 24 upon contact, but sufficiently high to avoid unintended migration of the liquid adhesive once it is applied to sheet 24. For example, in one embodiment, liquid adhesive is sufficiently viscous to avoid migration over edges 62 and/or 64 that could prevent full opening of bound document 14. In other embodiments, the adhesive of adhesive pad 74 is a substantially solid adhesive transferable to sheets 24 upon contact. In one embodiment, the adhesive of adhesive pad 74 is a hot melt adhesive, a cold glue, a water based adhesive, a moisture-carrying adhesive, a non-moisture-carrying adhesive, or any other suitable adhesive.

In one embodiment, cap 76 is coupled to support arm 72 and is configured to selectively cover adhesive pad 74 in a relatively tight manner to prevent or delay the adhesive of adhesive pad 74 from curing or drying out. Accordingly, cap 76 substantially encloses all exposed surfaces of adhesives pad 74. In one embodiment, cap 76 is rotatably coupled with support arm 72 and is configure to rotatably open and close (i.e., rotatably cover and uncover adhesive pad 74). Cap 76 is biased in a closed position. In one embodiment, cap 76 includes a cam 100 configured to facilitate rotation of cap 76 as desired during use. For example, cam 100 may function as a lever, such that when cam 100 is rotated, cap 76 also rotates between open and closed positions.

In one embodiment, cam activation member 78 is formed near and above saddle 40 along the path traversed by cam 100 as adhesive pad 74 is moved toward sheets 24. Cam activation member 78 is configured to interact with cam 100 causing cam 100 to rotate and thereby rotating cap 76 from a closed position (illustrated in FIG. 4A) to an open position (illustrated in FIG. 4B). In one embodiment, cam activation member 78 includes a substantially smooth and curvilinear surface 102. In other embodiments, cam surface 102 is substantially linear. However, other suitable cam activation member 78 may also be utilized.

During use, adhesive application assembly 26 is in the neutral position illustrated in FIG. 4A as sheets 24 are accumulated onto saddle 40 and as bound sheet stack 28 is removed from saddle 40. In the neutral position, cap 76 is in a closed position covering adhesive pad 74. After a new sheet 24 is added to saddle 40, drive mechanism 80 is activated to induce movement of support arm 72 and, therefore, adhesive pads 74, as generally indicated by arrow 82, toward saddle 40.

During rotation and prior to reaching saddle 40, cam 100 contacts cam activation member 78 as generally illustrated in the intermediate position illustrated in FIG. 4B. As cam 100 interacts with cam activation member 78, cam 100 rotates back toward support arm 72. Rotation of cam 100 causes cap 76 to rotate as generally indicated by arrow 104 away from adhesive pad 74 to a partially open position. As support arm 72 continues to rotate toward saddle 40, cam 100 continues to interact with cam activation member 78. Continued interaction with cam activation member 78 causes cam 100 to further rotate, thereby, further rotating cap 76 as indicated by arrow 104 into a fully open position while adhesive application assembly 70 is in the application position as illustrated in FIG. 4C. When cap 76 is opened, adhesive pad 74 is fully uncovered for interaction with saddle 40 and/or any sheet 24 positioned thereon. When adhesive pad 74 contacts sheet 24, adhesive is transferred from adhesive pad 74 to sheet 24, more specifically, to fold line 26 of sheet 24.

After applying adhesive to sheet 24, support arm 72 is moved back to neutral position either as dictated by drive mechanism 80 or due to biasing of support arm 72 to the neutral position. As support arm 72 transitions back to the neutral position, the forces applied to cam 100 by cam activation member 78 are diminished or removed, thereby, causing cap 76 to transition back to the closed position to which cap 76 is biased. Once support arm 72 is in the neutral position, another sheet 24 can be added to sheet stack 28. The new sheet 24 contacts the adhesive previously applied to adhere the new sheet 24 to sheet stack 28. In one embodiment, adhesive is applied to sheet stack 28 after each new sheet 24 is accumulated (i.e. between each sheet 24 in sheet stack 28). New sheets 24 can be accumulated and adhesive can be applied repeatedly until all sheets 24 to be included in bound document 14 have been adhered to one another as desired.

Figure 6:
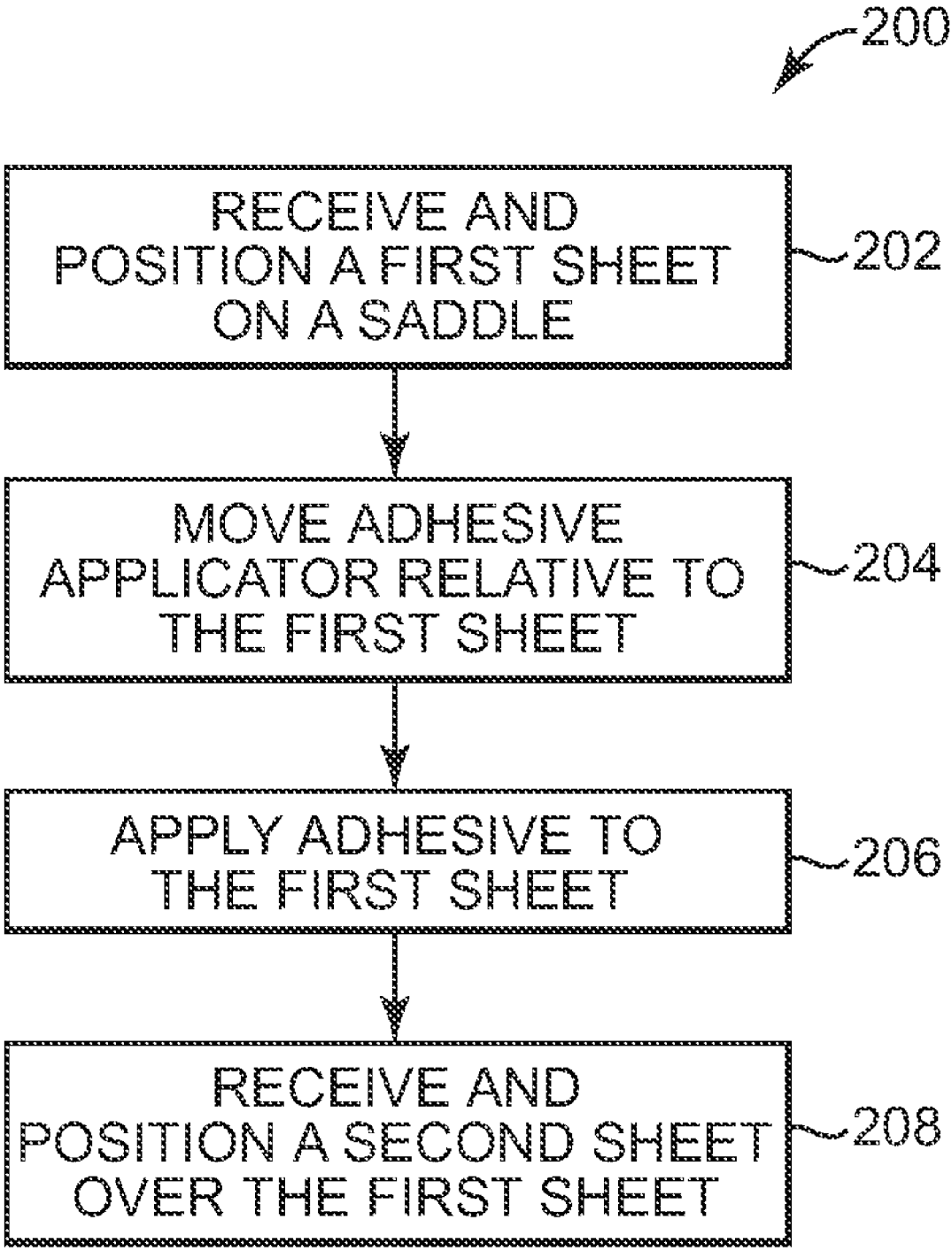
FIG. 6 is a flow chart illustrating one embodiment of a method of binding a document.

FIG. 6 illustrates one embodiment of a general method of binding sheets for a book at operation 200. At operation 202, a first sheet 24 to be included in bound document 14 is received and positioned on saddle 40. Receiving first sheet 24 includes advancing sheet 24 along a sheet path 30 extending substantially perpendicular to fold line 26 of sheet 24 (see FIG. 2). In one embodiment, positioning first sheet 24 includes aligning sheet 24 relative to saddle 40 and/or other sheets 24 already positioned on saddle 40. At operation 204, an adhesive applicator, such as adhesive applicator 58 or 74 is moved toward the first sheet 24, more specifically, toward fold line 26 of the first sheet 24.

At operation 206, adhesive applicator 58 or 74 applies adhesive over fold line 26 of first sheet 24. Adhesive applicator 58 or 74 is subsequently moved away from first sheet 24. At operation 208, a second sheet 208 is received and positioned on saddle 40, more specifically, on first sheet 24. Accordingly, second sheet 208 contacts the adhesive previously applied to first sheet 24, thereby, bonding second sheet 24 to first sheet 24. In one embodiment, operations 202, 204, 206, 208 are repeated until all sheets 24 to be included in bound document 14 have been added to sheet stack 28 and adhered to at least one other sheet 24 in sheet stack 28.

In one embodiment, books binding station 22*a* or 22*b* is controlled by a computer system or processor configured to execute a method of binding a book similar to method 200 per instructions read from a computer recordable medium. In one embodiment, the timing of any one or more operations 202, 204, 206, and 208 may be facilitated by sensors configured to detect the position of sheets 24 within binding stations 22*a* or 22*b*.

Although specific embodiments have been illustrated and described herein, it will be appreciated by those of ordinary skill in the art that a variety of alternate and/or equivalent implementations may be substituted for or combined to form variations of the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A method of binding a book, the method comprising:

receiving and positioning a first sheet over a substantially stationary saddle, wherein receiving the first sheet includes advancing the first sheet along a sheet path, extending substantially perpendicular to a fold line defined in the first sheet, at least until the first sheet remains in a stationary position on the substantially stationary saddle;

applying adhesive from an adhesive applicator, while moving the adhesive applicator parallel to and over a fold line of the first sheet, along the fold line while maintaining the first sheet in the stationary position on the saddle, wherein the adhesive applicator is a first adhesive applicator;

replacing the first adhesive applicator with a second adhesive applicator when adhesive in the first adhesive applicator has been consumed, wherein each of the first adhesive applicator and the second adhesive applicator are positioned independent and separate from a reservoir of adhesive; and receiving and positioning a second sheet over the first sheet on the saddle, wherein the adhesive applied along the fold line of the first sheet adheres the second sheet to the first sheet.

2. A method of binding a book, the method comprising:

receiving and positioning a first sheet over a substantially stationary saddle, wherein receiving the first sheet includes advancing the first sheet along a sheet path, extending substantially perpendicular to a fold line defined in the first sheet, at least until the first sheet remains in a stationary position on the substantially stationary saddle;

applying adhesive from an adhesive applicator, while moving the adhesive applicator parallel to and over a fold line of the first sheet, along the fold line while maintaining the first sheet in the stationary position on the saddle, wherein applying adhesive from the adhesive applicator includes arranging the adhesive applicator as a plurality of adhesive pads linearly spaced from one another in a direction extending substantially perpendicular to the fold line of the first sheet; and receiving and positioning a second sheet over the first sheet on the saddle, wherein the adhesive applied along the fold line of the first sheet adheres the second sheet to the first sheet.

3. The method of claim 2, wherein each respective adhesive pad includes a solid adhesive.

4. A method of binding a book, the method comprising:

receiving and positioning a first sheet over a substantially stationary saddle, wherein receiving the first sheet includes advancing the first sheet along a sheet path, extending substantially perpendicular to a fold line defined in the first sheet, at least until the first sheet remains in a stationary position on the substantially stationary saddle;

supplying adhesive to the adhesive applicator via coupling the adhesive applicator to an adhesive reservoir that is laterally spaced apart from the saddle in a direction generally perpendicular to the fold line;

applying adhesive from the adhesive applicator along the fold line of the first sheet while maintaining the first sheet in the stationary position, including:

supporting the adhesive applicator at a first end of an elongate arm;

selectively covering an adhesive pad of the adhesive applicator with a cap that includes a cam; and rotating the elongate arm to move the adhesive applicator from a first position laterally spaced apart from, and generally perpendicular to, the fold line toward the saddle to a second position generally parallel to, and in contact against the fold line of the first sheet to apply the adhesive to the first sheet, wherein during rotation of the elongate arm from the first position to the second position, releasably engaging the cap with a cam activation member that is positioned generally vertically above the saddle to selectively remove the cap from the adhesive applicator to expose the adhesive pad as the adhesive applicator is moved toward the saddle into the second position;

rotatably moving the adhesive applicator from the second position laterally away from the saddle to the first position, including moving the cap, via a biasing mechanism, to releasably close the adhesive applicator and contain the adhesive pad when the adhesive applicator is moved away from the saddle; and receiving and positioning a second sheet over the first sheet on the saddle, wherein the adhesive applied along the fold line of the first sheet adheres the second sheet to the first sheet.

5. The method of claim 4, wherein rotating the arm includes operating a drive mechanism to move a first end of the arm toward the saddle after the first sheet is placed on the saddle.

6. The method of claim 4, comprising arranging the elongate arm in the first position to permit removing a plurality of sheets from the saddle when the arm is in the first position.

7. A method of binding a book, the method comprising:

directing a series of sheets along a sheet path and onto a substantially stationary saddle, wherein the sheet path extends substantially perpendicular to a fold line defined in each of the respective sheets;

automatically applying adhesive via an adhesive applicator along the fold line of an outermost sheet of the respective sheets on the saddle, while maintaining the respective sheets in a stationary position on the saddle, via:

supporting the adhesive applicator at a first end of an elongate arm; and rotating the elongate arm to move the adhesive applicator from a first position laterally spaced apart from, and generally perpendicular to, the fold line toward the saddle to a second position generally parallel to, and in contact with the fold line of the outermost sheet; and rotatably moving the adhesive applicator from the second position away from the saddle to the first position; and directing a subsequent sheet over the outermost sheet on the saddle, wherein the adhesive applied along the fold line of the outermost sheet adheres the subsequent sheet to the outermost sheet.

8. The method of claim 7 wherein rotating the elongate arm to move the adhesive applicator into the position comprises:

providing the adhesive applicator in a storage mode via a cover rotatably biased to contain an adhesive pad of the adhesive applicator and arranging the cover to include a cam;

converting the adhesive applicator from the storage mode into an application mode in which the adhesive pad is exposed to deposit adhesive on the fold line, wherein the converting is performed via releasable engagement of the cam of the cover of the adhesive applicator against a cam engagement member as the elongate arm rotatably moves the adhesive applicator from the first position toward the saddle to the second position, wherein the cam engagement member is located generally vertically spaced above the saddle.

9. The method of claim 8, comprising:

after application of the adhesive on the fold line of the outermost sheet, rotatably moving the adhesive applicator from the second position to the first position to cause the cover to be released from engagement with the cam and allow the cover to contain the adhesive pad in the storage mode.

10. The method of claim 7, comprising:

supplying adhesive to the adhesive applicator via an adhesive reservoir that is coupled to the adhesive applicator, wherein the reservoir is spaced apart from the adhesive applicator and laterally spaced apart from the saddle in a direction generally perpendicular to the fold line of the outermost sheet.

11. The method of claim 7, comprising:

supplying the adhesive applicator to include a solid adhesive pad.

* * * * *